US009456699B1

(12) United States Patent
Oh

(10) Patent No.: US 9,456,699 B1
(45) Date of Patent: Oct. 4, 2016

(54) FOLDABLE BED FRAME

(71) Applicant: GRANTEC (XIAMEN) CO., LTD., Xiamen (CN)

(72) Inventor: Suk Kan Oh, Xiamen (CN)

(73) Assignee: GRANTEC (XIAMEN) CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/857,793

(22) Filed: Sep. 17, 2015

(30) Foreign Application Priority Data

Apr. 14, 2015 (CN) ..... 2015 2 0220950 U

(51) Int. Cl.
*A47C 19/12* (2006.01)
*A47C 19/02* (2006.01)

(52) U.S. Cl.
CPC ..... *A47C 19/122* (2013.01); *A47C 19/025* (2013.01); *A47C 19/021* (2013.01)

(58) Field of Classification Search
CPC .... A47C 19/00; A47C 19/005; A47C 19/02; A47C 19/021; A47C 19/025; A47C 19/027; A47C 19/028; A47C 19/12; A47C 19/122; A47C 23/005
USPC ..... 5/202, 201, 200.1, 250, 249, 259.1, 5/260, 261, 174, 176.1, 177
See application file for complete search history.

(56) References Cited

U.S. PATENT DOCUMENTS 4,654,905 A * 4/1987 Miller ..... A47C 23/005 5/249
7,376,988 B2 * 5/2008 Wickstrom ..... A47C 23/005 5/12.2
7,376,989 B2 * 5/2008 Wickstrom ..... A47C 17/225 5/250
7,406,727 B2 * 8/2008 Wickstrom ..... A47C 23/005 5/12.2
7,503,086 B2 * 3/2009 Wickstrom ..... A47C 17/225 5/174
8,312,576 B1 * 11/2012 Oh ..... A47C 23/005 5/174
8,370,973 B1 * 2/2013 Oh ..... A47C 19/122 5/174
8,407,834 B1 * 4/2013 Oh ..... A47C 23/005 5/174
8,769,740 B2 * 7/2014 Oh ..... A47C 19/12 5/174
8,898,832 B2 * 12/2014 Oh ..... A47C 19/12 5/174
9,226,590 B1 * 1/2016 Hull ..... F16B 12/56
2005/0251911 A1 * 11/2005 Wickstrom ..... A47C 23/005 5/247
2005/0251912 A1 * 11/2005 Wickstrom ..... A47C 23/005 5/249
2006/0123541 A1 * 6/2006 Wickstrom ..... A47C 17/225 5/249
2006/0230532 A1 * 10/2006 Wickstrom ..... A47C 17/225 5/250
2009/0293193 A1 * 12/2009 Neatherry ..... A47C 23/005 5/1
2012/0042449 A1 * 2/2012 Hull ..... A47C 23/005 5/246
2013/0067659 A1 * 3/2013 Oh ..... A47C 19/12 5/400
2013/0067862 A1 * 3/2013 Oh ..... A47C 23/005 53/429
2014/0283299 A1 * 9/2014 Oh ..... A47C 19/12 5/400

* cited by examiner

*Primary Examiner* — Robert G Santos
(74) *Attorney, Agent, or Firm* — Leong C. Lei

(57) ABSTRACT

The foldable bed frame contains two frame assemblies side-by-side and laterally joined together. Each frame assembly contains an upper assembly and a lower assembly. Upper beams from the two upper assemblies are end-to-end joined together through upper connection pieces. Lower beams from the two lower assemblies are end-to-end joined together through lower connection pieces and intermediate connection pieces between the lower beams and the lower connection pieces. The various connection pieces are light-weighted and reliable, allowing the bed frame to be folded and unfolded smoothly and conveniently.

4 Claims, 6 Drawing Sheets

FOLDABLE BED FRAME

BACKGROUND OF THE INVENTION (a) Technical Field of the Invention

The present invention is generally related to bed frames, and more particular to a foldable bed frame.

(b) Description of the Prior Art

A conventional foldable bed frame contains two frame assemblies laterally joined together by an intermediate connection member in between. The connection member usually has two sets of holes, each for pin joining with one of the frame assemblies. To achieve folding, the distances between the two sets of holes has to be different and the connection member has to maintain specific width and volume, thereby increasing the weight of the entire bed frame.

SUMMARY OF THE INVENTION

Therefore a novel foldable bed frame is provided herein. The foldable bed frame has light-weighted and reliable connection pieces between two frame assemblies, allowing the frame assemblies to be collapsed together smoothly and conveniently.

Specifically, the foldable bed frame contains two frame assemblies joined side-by-side and laterally together by a number of upper, lower, and intermediate connection pieces. Each frame assembly contains a planar upper assembly, a planar lower assembly, and a plurality of vertical column pieces in between. Each upper assembly contains two parallel first upper beams and two parallel second upper beams end-to-end connected together. Each lower assembly contains two parallel first lower beams and two parallel second lower beams end-to-end connected together. Each column piece has its two ends connected to the upper and lower assemblies, respectively. Each upper connection piece has its two ends connected two first upper beams, one from each upper assembly, respectively, and a support section extended perpendicularly from a major lower edge for supporting the two first upper beams. Each lower connection piece contains a flat upper section and a flat lower section. Each lower section has its two sides connected two first lower beams, one from each upper assembly, respectively. Each intermediate connection piece has its two ends connected to an upper section of a lower connection piece and a first lower beam of a lower assembly, respectively.

Each upper connection piece has two through holes at its two ends, each for pin-joining a first upper beam of an upper assembly. The lower section of each lower connection piece has two through holes adjacent to its two lateral edges, each for pin-joining a first lower beam of a lower assembly. The distance between the through holes on each lower section is smaller than that between the through holes on each upper connection piece.

Each column piece has an L-like shape with a flat and major first segment having a first through hole at a first end and a flat, coplanar, and shorter second segment extended perpendicularly from a second end oppositely from the first end of the first segment. The first segment of each column piece has two flat support tabs adjacent to and extended from the first and second ends of the first segment, respectively, perpendicular to first and second segments' major faces. When assembling the frame assemblies, the support tabs of each column piece are between and against an upper beam and a lower beam, respectively.

Each of the column pieces of one frame assembly that is closest to the other frame assembly has an indented section in the column piece's first segment for joining with an intermediate connection piece.

Compared to the prior art, the foldable bed frame according to the present invention relies on innovatively designed connection pieces to join two frame assemblies of the bed frame. The various connection pieces are light-weighted and reliable, allowing the frame assemblies to be folded and unfolded smoothly and conveniently. Additionally, enhanced and more robust support is attained when the frame assemblies are unfolded.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
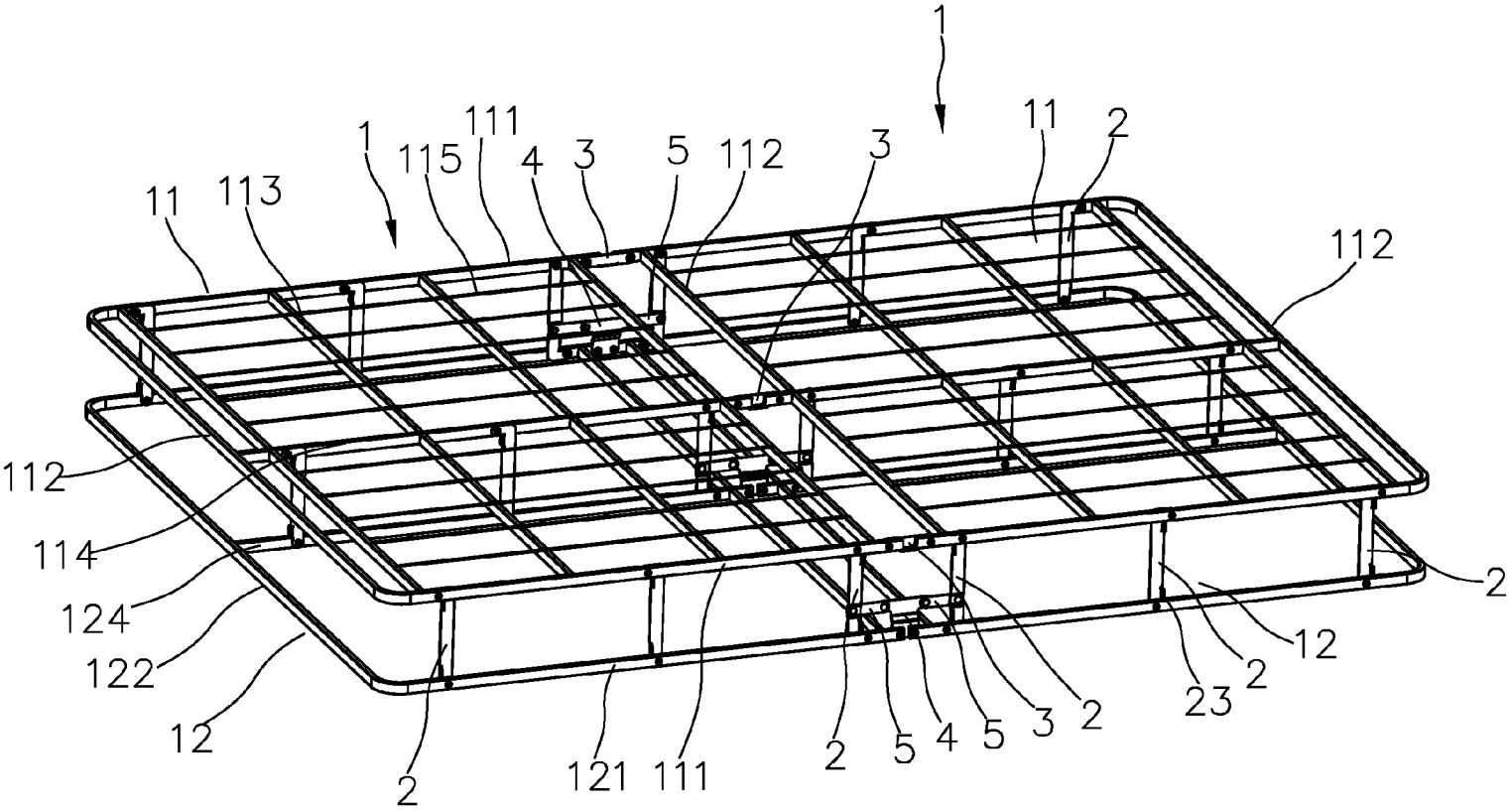
FIG. 1 is a perspective diagram showing a foldable bed frame according to an embodiment of the present invention.

As shown in FIG. 1, a foldable bed frame according to an embodiment of the present invention contains two frame assemblies 1. The two frame assemblies 1 are side-by-side and laterally joined together. Each frame assembly 1 contains an upper assembly 11 and a lower assembly 12. The upper assembly 11 contains two parallel first upper beams 111 and two parallel second upper beams 112 end-to-end connected together. A number of third upper beams 113 have their two ends connected to the two first upper beams 111, respectively. Similarly, a number of fourth upper beams 114 have their two ends connected to the two second upper beams 112, respectively. The third and fourth upper beams 113 and 114 reinforce the frame assembly 1 in supporting a mattress or a bed plank. Some additional thin fifth upper beams 115 can be configured between the second upper beams 112 similarly. The lower assembly 12 contains two parallel first lower beams 121 and two parallel second lower beams 122 end-to-end connected together. A number of fourth lower beams 124 have their two ends connected to the two second lower beams 122, respectively. Each fourth lower beam 114 is located right below a corresponding fourth upper beam 114.

Figure 7A:
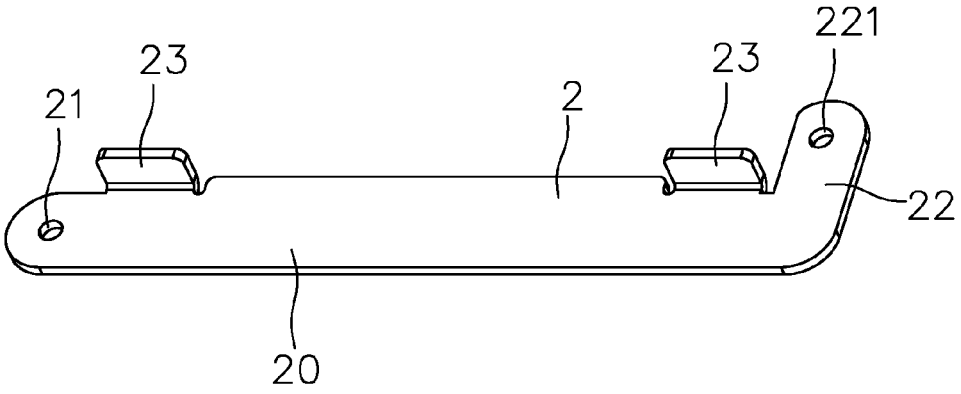
FIG. 7A is a perspective diagram showing a column piece adopted in the foldable bed frame of FIG. 1.
Figure 7B:
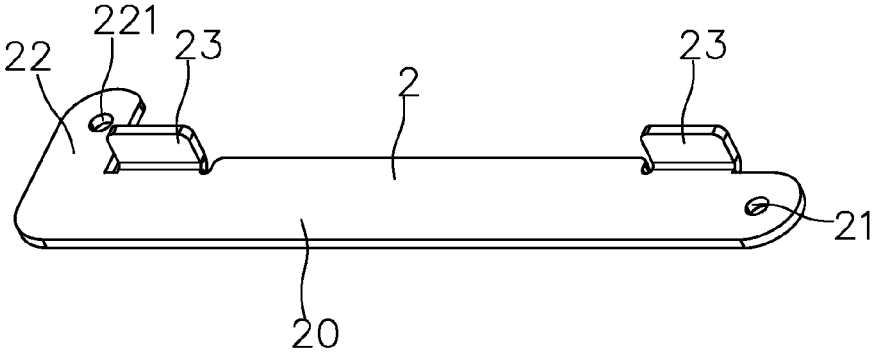
FIG. 7B is a perspective diagram showing a second embodiment of the column piece of FIG. 7A.

Each frame assembly 1 further contains a number of flat column pieces 2, each having its two ends connected to the upper and lower assemblies 11 and 12, respectively. In the present embodiment, each frame assembly 1 has three sets of column pieces 2, and each set has three column pieces 2. Two sets of column pieces 2 are configured between the two pairs of corresponding first upper beams 111 and first lower beams 121, respectively. Another set of column pieces 2 is configured between a pair of corresponding fourth upper and lower beams 114 and 124. For each set of column pieces 2, one is located in a middle location whereas the other two are located adjacent to the two ends of the upper and lower beams. As shown in FIGS. 7A and 7B, each column piece 2 has a L-like shape with a flat and major first segment 20 having a first through hole 21 at a first end. A flat, coplanar, and shorter second segment 22 is extended perpendicularly from a second end oppositely from the first end of the first segment 20. The second segment 22 has a width compatible to that of the beams, and a second through hole 221 at an end of the second segment 22 farthest away from the first segment 20. The first and second through holes 21 and 221 are for connection with the upper and lower beams, respectively. In addition, the first segment 20 of each column piece 2 has two flat support tabs 23 adjacent to and extended from the first and second ends of the first segment 20, respectively, perpendicular to first and second segments' major faces. When assembling the frame assemblies 1, the support tabs 23 of each column piece 2 will be against the upper and lower beams. Taking a column piece 2 between a first upper beams 111 and a first lower beams 121 as example, one of the column piece 2's support tab 23 is right beneath the upper beam 111 whereas the other support tab 23 of the column piece 2 is right above the lower beam 121. Together with FIG. 1, when the bed frame is in its unfolded state, it should be clear that the support tabs 23 provides additional support and positioning to the beams, and the extension direction of the support tabs 23 can be different from what is depicted in FIGS. 7A and 7B, depending on the support tab 23's location within the bed frame.

In order to achieve the folding of the bed frame, the two frame assemblies 1 have their corresponding first upper and lower beams 111 and 121, and fourth upper and lower beams 114 and 124 end-to-end pin-joined together by flat upper and lower connection pieces 3 and 4. As shown in FIGS. 1, and 6 to 8B, an upper connection piece 3 is used to connect a pair of corresponding upper beams 111 and 114. Each upper connection piece 3 has two through holes 31 at its two ends, each for pin-joining an upper beam 111 or 114 of a frame assembly 1. Each upper connection piece 3 further has a support section 32 extended perpendicularly from a major lower edge. When the bed frame is unfolded, the support section 32 of an upper connection piece 3 provides support to the two upper beams 111 or 114 joined by the upper connection piece 3.

Figure 8A:
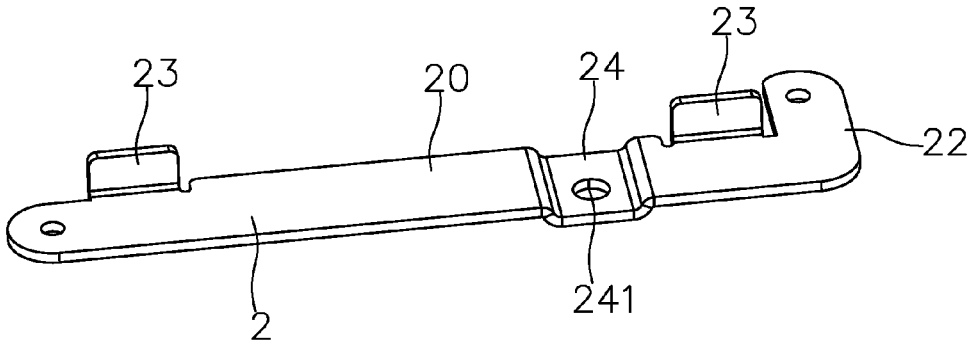
FIG. 8A is a perspective diagram showing a third embodiment of the column piece of FIG. 1 when it is deployed closest to the other frame assembly in the foldable bed frame of FIG. 1.
Figure 8B:
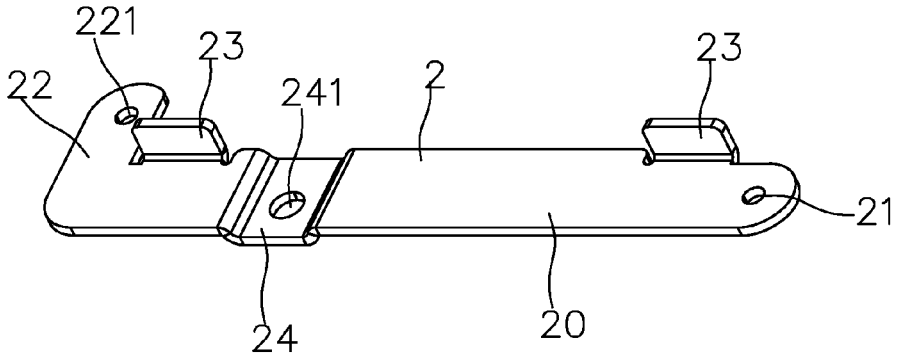
FIG. 8B is a perspective diagram showing a fourth embodiment of the column piece of FIG. 1 when it is deployed closest to the other frame assembly in the foldable bed frame of FIG. 1.

Similarly, a lower connection piece 4 is used to connect a pair of corresponding lower beams 121 and 124. Each lower connection piece 4 contains a flat upper section 42 and a flat lower section 41. Each lower section 41 has two through holes 411 adjacent to its two lateral edges, each for pin-joining a lower beam 121 or 124 of a frame assembly 1. The distance between the through holes 411 is smaller than that between the through holes 31 so as to provide the required leverage space when the two frame assemblies 1 are folded towards each other. Each upper section 42 has a greater width than its corresponding lower section 41. Each upper section 42 also has two through holes at its two ends, each for pin-joining an end of an intermediate connection piece 5. Each intermediate connection piece 5 has its another end pin-joined to a middle spot of a column piece 2 that is one of the column pieces 2 closest to the other frame assembly 1. Additionally, as shown in FIGS. 8A and 8B, in order to adapt to the connection of an intermediate connection piece 5, each of the column pieces 2 closest to the other frame assembly 1 has an indented section 24 with a central through hole 241 for joining with the intermediate connection piece 5 in the column piece 2's first segment 20. The indented section 24 is located between and adjacent to one of the support tabs 23.

As described above, each intermediate connection piece 5 pin-joins a column piece that is closest to the other frame assembly 1 while each lower connection piece 4 pin-joins two lower beams 121 or 124. As such, not only the folding of the frame assemblies 1 is achieve, but also an enhanced and more robust support is attained when the frame assemblies 1 are unfolded.

Figure 2:
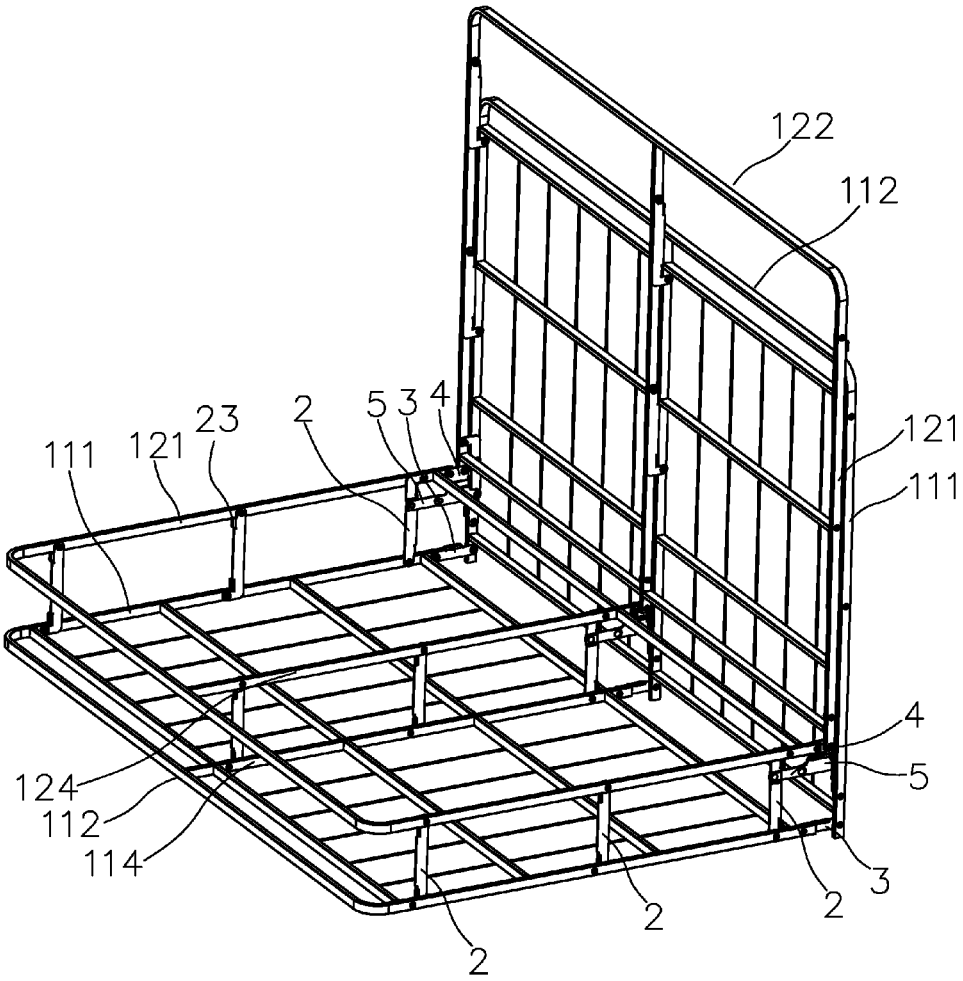
FIG. 2 is a perspective diagram showing the foldable bed frame of FIG. 1 when it is folded.
Figure 3:
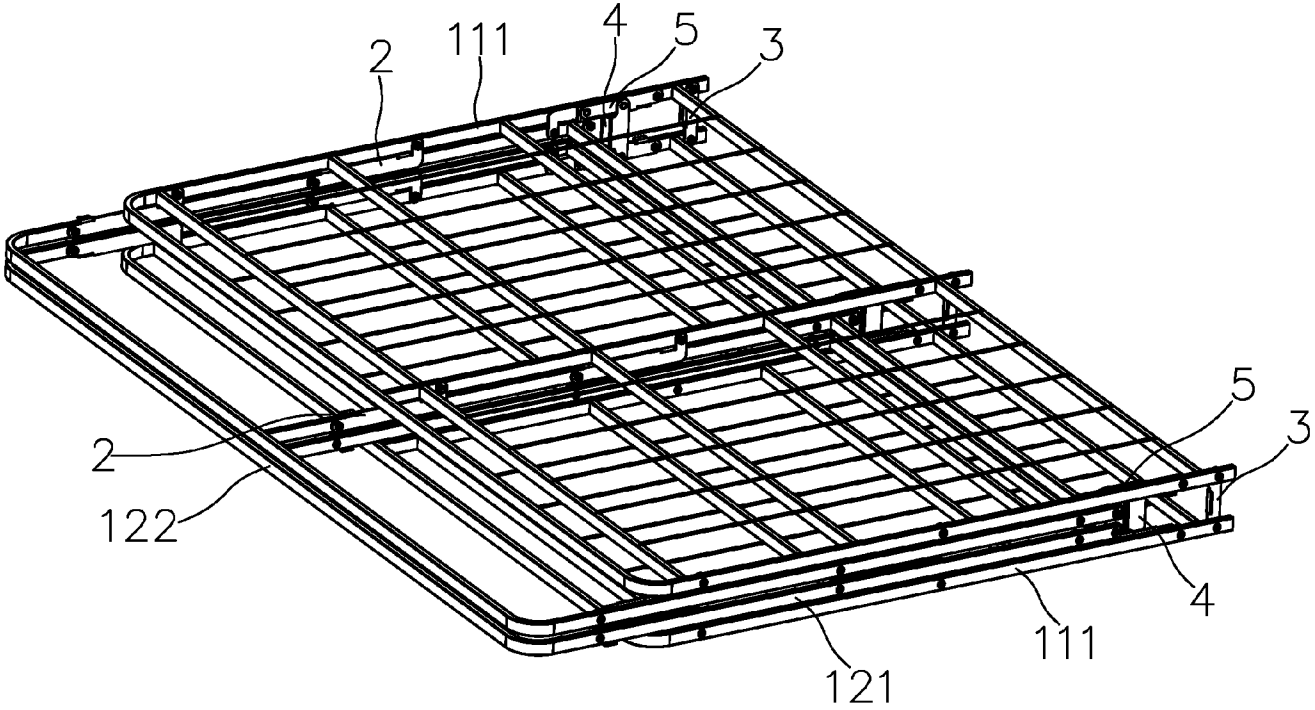
FIG. 3 is a perspective diagram showing the foldable bed frame of FIG. 1 after it is folded.
Figure 4:
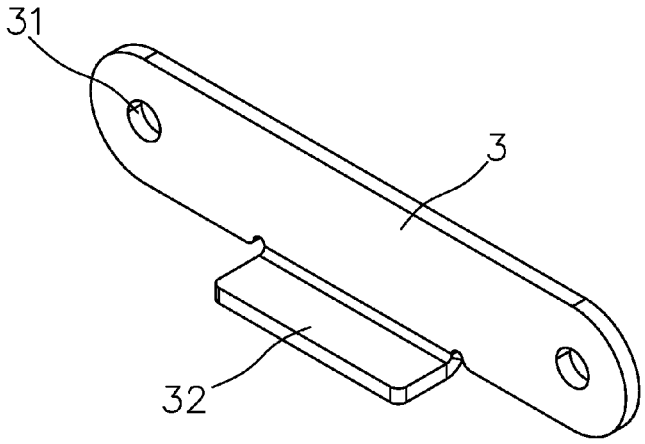
FIG. 4 is a perspective diagram showing an upper connection piece adopted in the foldable bed frame of FIG. 1.
Figure 5:
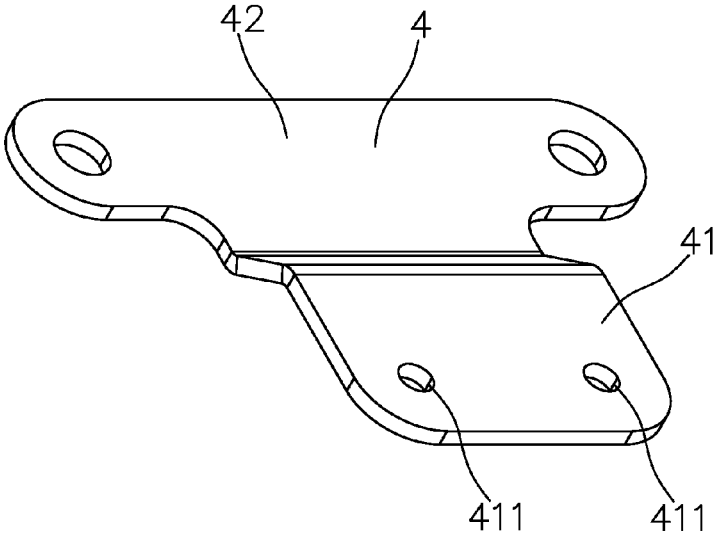
FIG. 5 is a perspective diagram showing a lower connection piece adopted in the foldable bed frame of FIG. 1.
Figure 6:
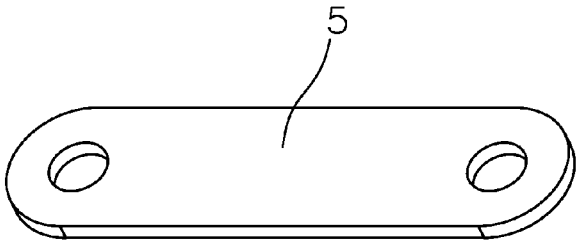
FIG. 6 is a perspective diagram showing an intermediate connection piece adopted in the foldable bed frame of FIG. 1.

As shown in FIGS. 1 to 3, to fold the bed frame, one of the frame assemblies 1 is turned clockwise 90 degrees. In the meantime, the turned frame assembly 1's upper and lower assemblies 11 and 12 collapses towards each other. Then, similarly, the other frame assembly 1 is turned counterclockwise 90 degrees while the turned frame assembly 1's upper and lower assemblies 11 and 12 collapses towards each other. Finally, as shown in FIG. 3, the two frame assemblies 1 are closed together and attached to each other and their upper and lower assemblies 11 and 12 are all stacked together. Please note that the upper connection pieces 3 will be located along a side of the folded bed frame.

To unfold, the above described steps are conducted in reversed order, and a rigid bed frame is achieved. Compared to the prior art, the present invention relies on innovatively designed connection pieces to join two frame assemblies of the bed frame. The various connection pieces are light-weighted and reliable, allowing the bed frame to be folded and unfolded smoothly and conveniently.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A foldable bed frame comprising two frame assemblies joined side-by-side and laterally together by a plurality of upper, lower, and intermediate connection pieces, wherein each frame assembly comprises a planar upper assembly, a planar lower assembly, and a plurality of vertical column pieces in between;

each upper assembly comprises two parallel first upper beams and two parallel second upper beams end-to-end connected together;

each lower assembly comprises two parallel first lower beams and two parallel second lower beams end-to-end connected together;

each column piece has two ends connected to the upper and lower assemblies, respectively;

each upper connection piece has two ends connected to two first upper beams, one from each upper assembly, respectively, and a support section extended perpendicularly from a major lower edge for supporting the two first upper beams;

each lower connection piece comprises a flat upper section and a flat lower section; each lower section has two sides connected to two first lower beams, one from each lower assembly, respectively; and each intermediate connection piece has two ends connected to an upper section of a lower connection piece and a column piece, respectively.

2. The foldable bed frame according to claim 1, wherein each upper connection piece has two through holes at two ends thereof, each for pin-joining a first upper beam of an upper assembly; each lower section of each lower connection piece has two through holes adjacent to its two lateral edges thereof, each for pin-joining a first lower beam of a lower assembly; the distance between the through holes on each lower section is smaller than that between the through holes on each upper connection piece.

3. The foldable bed frame according to claim 1, wherein each column piece has a L-shaped with a flat and major first segment having a first through hole at a first end and a flat, coplanar, and shorter second segment extended perpendicularly from a second end oppositely from the first end of the first segment; the first segment of each column piece has two flat support tabs adjacent to and extended from the first and second ends of the first segment, respectively, perpendicular to first and second segments' major faces; and, when assembling the frame assemblies, the support tabs of each column piece are between and against an upper beam and a lower beam, respectively.

4. The foldable bed frame according to claim 3, wherein each of the column pieces of one frame assembly that is closest to the other frame assembly has an indented section in the column piece's first segment for joining with an intermediate connection piece.

* * * * *